United States Patent [19]

Davis

[11] 4,113,250

[45] Sep. 12, 1978

[54] MOTORIZED INVERTING EXERCISER WITH BODY GUARD PERMITTING SELECTION OF DESIRED STRESS

[76] Inventor: Edward B. Davis, 115 Walnut Dr., St. Charles, Ill. 60174

[21] Appl. No.: 697,361

[22] Filed: Jun. 18, 1976

[51] Int. Cl.[2] ..... A63B 21/00

[52] U.S. Cl. ..... 272/93; 128/25 R; 272/146

[58] Field of Search ..... 272/1 R, 28 R, 28 S, 272/33 R, 33 A, 36–39, 49, 50, 51, 42, 93, 146, 109, 114, 134, 115, DIG. 4; 128/23, 24 R, 25 R; 35/12 P; 124/6

[56] References Cited

U.S. PATENT DOCUMENTS

| | | | |
|---|---|---|---|
| 1,393,456 | 10/1921 | Ruggles | 35/12 P |
| 2,711,726 | 6/1955 | Darrell | 124/6 |
| 3,083,037 | 3/1963 | Gordon et al. | 272/115 X |
| 3,276,777 | 10/1966 | Pruitt | 272/33 R |
| 3,286,707 | 11/1966 | Shafer | 128/24 R |
| 3,628,791 | 12/1971 | Garcia | 272/DIG. 4 X |
| 3,752,153 | 8/1973 | Copeland | 128/24 R |
| 3,911,907 | 10/1975 | Smith | 272/146 X |
| 3,936,047 | 2/1976 | Brandt et al. | 272/146 |

*Primary Examiner*—William R. Browne

*Attorney, Agent, or Firm*—Eugene F. Friedman; Elmer L. Zwickel

[57] ABSTRACT

An exercising apparatus including an adjustable body frame mounted to be rotated in uninterrupted motion 360° and having a body support including a fixed hand hold and a foot support, the latter being capable of being rotated out of the plane of the body frame to enable the user to rotate head over foot sideways. The body support includes a substantially circular enclosure with a diameter substantially larger than the body of a user to permit movement of the body in any lateral direction. The body support, at any position of the body frame about the its horizontal axis of rotation, selectively reduces by any one of a plurality of different amounts the exertion required of the user to support the component of his body weight lying non-parallel to the longitudinal axis of while the user's body rotates with the frame.

19 Claims, 5 Drawing Figures

MOTORIZED INVERTING EXERCISER WITH BODY GUARD PERMITTING SELECTION OF DESIRED STRESS

The present invention relates to apparatus useful for body therapy, kinetic exercise and isometric exercise. More particularly, the apparatus is provided as means to assist a person to perform what normally would be difficult motions and exercise of therapeutic signifigance. Known apparatus useful for excercising the body comprises tables and slabs that are tiltable into different planes short of 360°. One such apparatus is disclosed in U.S. Pat. No. 3,388,700, and one that supports the body irrespective of its position, is disclosed in U.S. Pat. No. 3,152,802.

Specifically, the apparatus embodies a rectangular body frame structure mounted so as to be rotated about a horizontal axis by power means and which has suitable emergency supports for the head, neck, upper body and back. These supports normally are not used but are present only to support portions of the body should the need arise. It also includes a foot support and an overhead hand-hold, the former being movable out of the plane of the body frame to afford its use not only as support means during rotation of the body frame, but also as support means when rotating the body sideways as when performing a "cart-wheel."

It is therefore an object of the invention to provide apparatus of the character referred to.

Another object is to provide power driven means to carry the apparatus body frame through a full rotation of 360°.

Another object is to provide the body frame with an adjustable foot support and hand hold.

Another object is to provide novel support means on the body frame for various parts of the body of a person positioned in the body frame.

Another object is to provide a body frame that is adjustable to accomodate persons of different heights.

Another object is to provide apparatus of the character referred to which is not expensive or difficult to manufacture and which is very efficient in use.

These and other objects of the invention will become apparent with reference to the following description and accompanying drawings.

IN THE DRAWINGS

Figure 1:
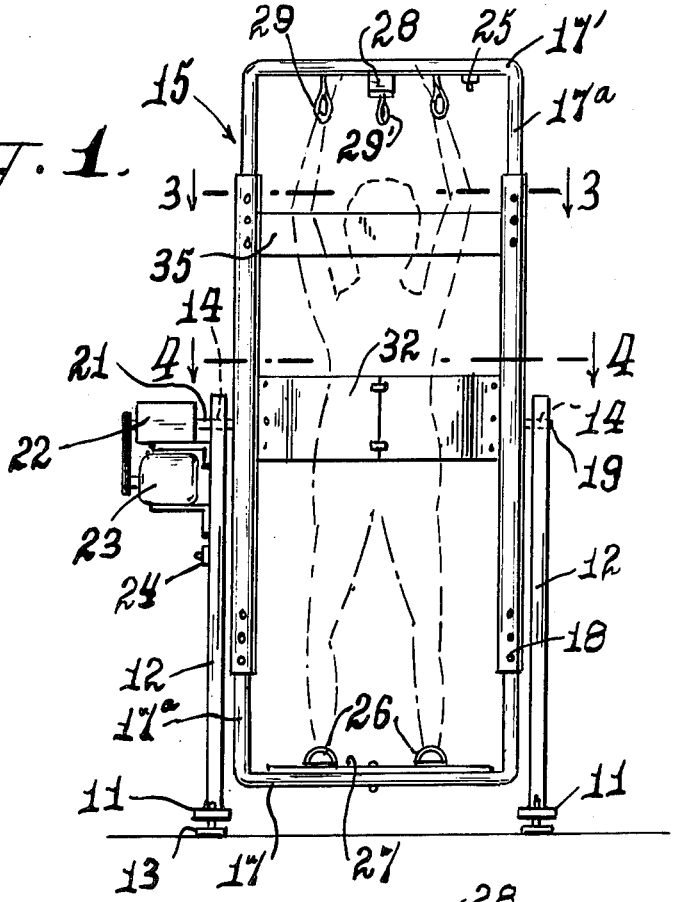
FIG. 1 is a front elevation view of the apparatus, illustrating the position of a body therein.

Referring now to the exemplary embodiment of the invention as shown in the accompanying drawings, the apparatus includes a support framework comprised of spaced apart parallel base members 11 each having a rigid upstanding member, such as post 12. The base members may have floor leveling pads 13 on their ends. The upper extremities of posts 12 have horizontallly aligned bearings 14.

The body frame structure 15 is rectangular in shape and preferably is comprised of center tubular elements 16 connected at their respective ends by U-shaped elements 17 having their legs **17*a* telescoped one into the respective end of the center elements 16. Means in the form of pins 18 may be provided to retain the U-shaped elements in any desired position of adjustment so as to permit adjustment of the body frame to accomodate the person of different size using the apparatus. Midway between the ends of each center element 16, are stud shafts 19,21, which shafts are freely journalled in the respective post bearings 14**.

Figure 2:
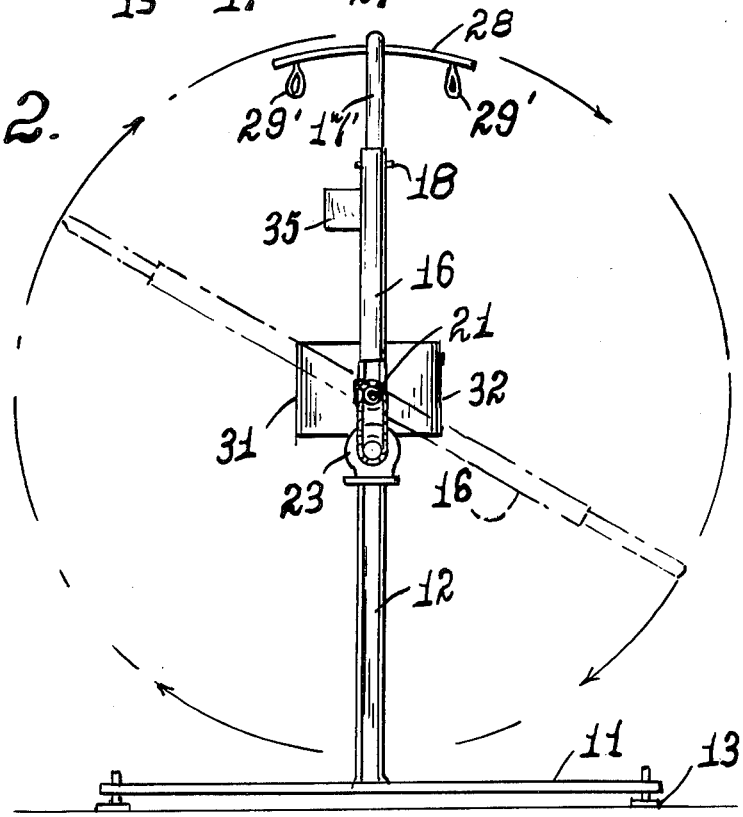
FIG. 2 is a side elevational view of the apparatus.
Figure 3:
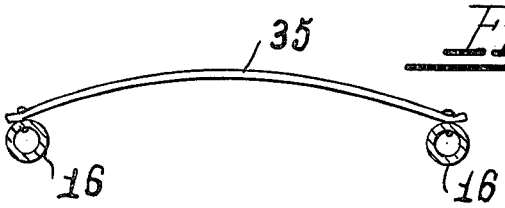
FIG. 3 is a sectional view of the body frame taken on line 3—3 of FIG. 1.

The stud shaft 21 is connected, through a reduction gear box 22, to an electric motor 23, having three-way control switches 24, 25, in its power circuit. The switch 24 is located on the support frame for use by one outside the apparatus and the other switch 25 is located on the body frame structure in the area of the hands of the person riding the apparatus. As commonly known, when either switch is actuated to supply current to the motor 23, the body frame 15 is roatated slowly so as to cause a person mounted in the body frame to roll over forwardly head to foot as best illustrated in FIG. 2.

The rider, facing forward in the frame 15, will place his feet in stirrups 26 carried on a foot support bar 27 pivotally secured, for a purpose to be explained presently, to the lower or foot end frame element 17. The upper or head end frame element 17′ carries a bar 28 fixedly disposed at right angles to the plane of the body frame. Both the upper frame element 17′ and the bar 28 each have a pair of wrist straps or loops 29–29′ thereon. When in this position, the rider thrusts his hands through loops 29 and then grips the U-shaped member 17′. Upon rotation of the frame 15, the rider will turn over forwardly through 360°.

Figure 4:
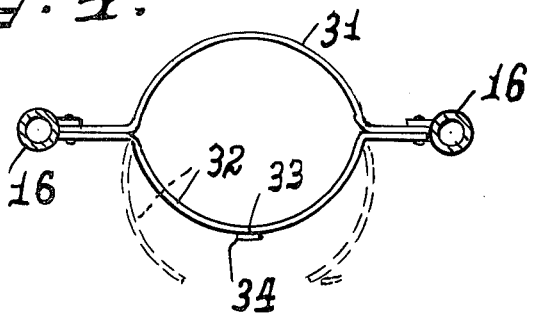
FIG. 4 is a sectional view of the body frame taken on line 4—4 of FIG. 1.

In order to afford emergency support for the rider's body, the medial region of body frame 15 carries a harness or body guard 31,32 (FIG. 4) of sheet material such as leather or vinyl, which surrounds the body but does not normally constrain it. Preferably one of these guards (guard 32) is arranged to open up to admit the rider's body and then be closed securely. This can be accomplished by slitting one of the guards, as at 33, and providing quick action snaps such as those illustrated at 34. Also, a strip of soft material 35 such as leather, vinyl or the like, can be extended between the legs **17*a* of the head end frame element 17′**, to provide support means for the user's head and neck should he require such support.

It should be quite evident that a person riding in the body frame structure 15, with his feet engaged in stirrups 26 and his hands extended overhead through the loops 29 and grasping the upper or head frame element 17′, will be turned over forwardly head to foot and back again during 360° rotation of the frame. His head, neck and middle portion can be adequately supported by the strip 35, and guard 31–32, should the rider require such support, although more beneficial results arise from use of the apparatus without reliance upon such supports. By relying on the supports, a user can be almost completely relaxed during the period of operation of the apparatus. Now, in such instance, after apparatus use for a period of time, with the various support means in place, one can progressively move his body away from the individual support means, one at a time, and thus progressively increase the amount of exercise required of the user to remain in place on the frame. In the final stage, he will be supported only by his foot and the hand holds and is thus subjected to the most streneous exercise.

Figure 5:
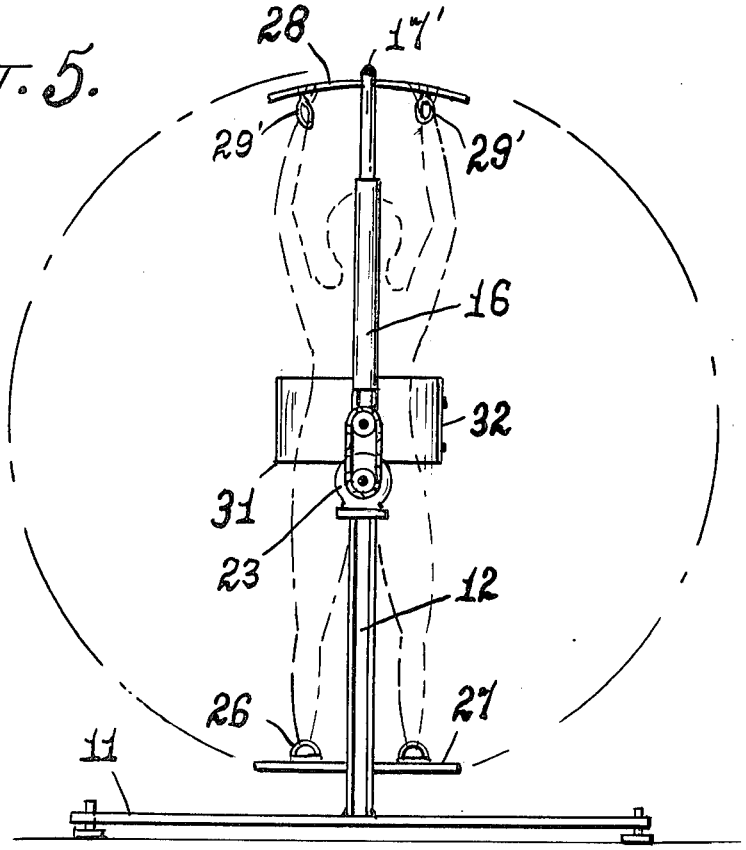
FIG. 5 is a side view similar to FIG. 2, showing the foot support and hand hold positioned a right angles to the plane of the body frame.

Should the rider desire to be rotated in a direction resembling the movement entailed when performing a "cart-wheel," as illustrated in FIG. 5, the foot bar 27 is rotated into a position at right angles to the plane of the body frame. Now, with the rider engaging his wrists in the bar loops 29' while standing sideways relative to the body frame, the rider will be rotated sidewise through 360° when the body frame 15 is rotated.

Although a chain drive has been illustrated it should be apparent that a direct drive would be equally as effective.

Although I have described a preferred embodiment of the invention, in considerable detail, it will be understood that the description thereof is intended to be illustrative rather than restrictive, as details of the structure may be modified or changed without departing from the spirit or scope of the invention. Accordingly, I do not desire to be restricted to the exact construction shown and described.

I claim:

1. A theraputic apparatus for exercising the body of the user comprising (A) a substantially rectangular body frame journalled approximately midway between its longitudinal ends for 360° rotation on a horizontal axis, said body frame having a head end at one of its longitudinal ends and a foot end at the other of its longitudinal ends, supports for the feet of the user mounted at the foot end of the rectangular body frame, and means on the head end of said body frame engageable by the user to maintain his position in the body frame; (B) support framework means coupled to said body frame for rotationally supporting said body frame where journalled; (C) power means coupled to said body frame for rotating said body frame with uninterrupted motion of 360° about said axis; and (D) body support means coupled to said body frame for, at any position of said body frame about said axis, selectively reducing by any one of a plurality of different amounts the exertion required of the user to support the component of his body weight lying nonparallel to the longitudinal axis of his body while having a position in said body frame as said body frame rotates, one of said amounts being substantially zero, said body support means including a substantially circular enclosure with a diameter substantially larger than the body of a user to permit movement of the body in any lateral direction, said power means having the ability to rotate said body frame all of said 360° about said axis regardless of the position of the body of the user relative to said body support means.

2. The apparatus recited in claim 1 wherein said support framework means includes upstanding elements for supporting the body frame.

3. The apparatus recited in claim 1 wherein the user engageable means on the head end of the body frame comprises wrist straps.

4. The apparatus recited in claim 3, wherein the head end of the body frame carries a support element disposed at right angles to the plane of the body frame on which wrist straps are mounted.

5. The apparatus recited in claim 1 wherein the body support means comprises a harness loosely surrounding the body of the user.

6. The apparatus recited in claim 1 wherein head and neck support means is carried by the body frame.

7. The apparatus recited in claim 6 wherein the head and neck support means comprises a strap bridging the body frame at the head end thereof.

8. The apparatus recited in claim 1 wherein the length of the rectangular body frame is adjustable.

9. The apparatus recited in claim 1 wherein the foot end of the body frame carries a pivotally mounted element on which foot supports are mounted.

10. The apparatus recited in claim 9 wherein the pivotally mounted element is movable into a plane substantially at right angles to the plane of the body frame and said body support means allows the body of a user, while in said support means, to turn between a plane parallel to the plane of said body frame to a plane substantially at right angles to the plane of said body frame.

11. The apparatus recited in claim 1 wherein the support framework has floor level means thereon.

12. The apparatus recited in claim 1 wherein the supports for the feet comprise stirrups.

13. A therapeutic apparatus for exercising the body of a user comprising a support framework including spaced apart uprights, a substantially rectangular body frame journalled between its longitudinal ends to said uprights for 360° rotation about a horizontal axis, power means to rotate said body frame with uninterrupted motion of 360° in the support framework about said axis, foot support means at one of said longitudinal ends of said frame, hand-hold means at the other of said longitudinal ends of said body frame, and body embracing means coupled to said body frame for, at any position of said body frame about said axis, selectively reducing by any one of a plurality of different amounts the exertion required of the user to support the component of his body weight lying nonparallel to the longitudinal axis of his body while having a position in said body frame as said body frame rotates, one of said amounts being substantially zero, said body support means including a substantially circular enclosure with a diameter substantially larger than the body of a user to permit movement of the body in any lateral direction.

14. The apparatus recited in claim 13 wherein the body embracing means comprises a pair of strap elements disposed to lie one in front of and one in back of the user's body and means in one of said straps enabling it to be separated to admit the body into the embracing means.

15. The apparatus recited in claim 14 wherein said foot support means includes foot supports mounted on an element pivotally mounted to said body frame, said element being movable into a plane substantially at right angles to the plane of said body frame; said other end of the body frame carries a support element disposed at right angles to the plane of said body frame; and said body embracing means allows the body of the user, while in said body embracing means, to turn between a plane parallel to the plane of said body frame to a plane substantially at right angles to the plane of said body frame.

16. The apparatus recited in claim 15 further including head and neck support means coupled to said body frame adjacent to the hand-hold means.

17. The apparatus recited in claim 14 further including head and neck support means coupled to said body frame adjacent to the hand-hold means.

18. A theraputic apparatus for exercising the body of the user comprising (A) a substantially rectangular body frame journalled approximately midway between its longitudinal ends for 360° rotation on a horizontal axis, said body frame having a head end and a foot end, supports for the feet of the user mounted at the foot end of the rectangular body frame, and means on the head end of said body frame engageable by the user to maintain his position in the body frame, said body frame including, at its foot end, a pivotally mounted element on which foot supports are mounted, said pivotally mounted elements being movable into a plane substantially at right angles to the plane of the body frame; (B) support framework means coupled to said body frame for rotationally supporting said body frame where journalled; (C) power means coupled to said body frame for rotating said body frame 360° about said axis; and (D) body support means coupled to said body frame for selectively reducing by any one of a plurality of different amounts the exertion required of the user to support the component of his body weight lying nonparallel to the longitudinal axis of his body while having a position in said body frame as said body frame rotates, one of said amounts being substantially zero, said body support means allowing the body of a user, while in said support means, to turn between a plane parallel to the plane of said body frame to a plane substantially at right angles to the plane of said body frame.

19. A therapeutic apparatus for exercising the body of a user comprising a support framework including spaced apart uprights, a substantially rectangular body frame journalled between its longitudinal ends to said uprights for 360° rotation about a horizontal axis, power means to rotate said body frame 360° in the support framework about said axis; foot support means at one end of said frame including foot supports mounted on an element pivotally mounted to said body frame, said element being movable into a plane substantially at right angles to the plane of said body frame; hand-hold means at the other end of said body frame, said hand-hold means including a support element disposed at right angles to the plane of said body frame; and body embracing means coupled to said body frame for selectively reducing by any one of a plurality of different amounts the exertion required of the user to support the component of his body weight lying nonparallel to the longitudinal axis of his body while having a position in said body frame as said body frame rotates, one of said amounts being substantially zero, said body embracing means allowing the body of the user, while in said body embracing means, to turn between a plane parallel to the plane of said body frame to a plane substantially at right angles to the plane of said body frame.

* * * * *